United States Patent [19]

Eheim

[11] 4,380,221

[45] Apr. 19, 1983

[54] REGULATING DEVICE FOR A FUEL INJECTION PUMP

[75] Inventor: Franz Eheim, Stuttgart, Fed. Rep. of Germany

[73] Assignee: Robert Bosch GmbH, Fed. Rep. of Germany

[21] Appl. No.: 231,654

[22] Filed: Feb. 5, 1981

[30] Foreign Application Priority Data

Feb. 5, 1980 [DE] Fed. Rep. of Germany ..... 3004035

[51] Int. Cl.[3] ..... F02M 59/20

[52] U.S. Cl. ..... 123/343; 123/357; 123/500

[58] Field of Search ..... 123/343, 357, 358, 500, 123/503; 73/119 A

[56] References Cited

U.S. PATENT DOCUMENTS

| | | | |
|---|---|---|---|
| 3,661,130 | 5/1972 | Eheim | 123/358 X |
| 3,871,344 | 3/1975 | Pigeroulet et al. | 123/358 |
| 4,318,378 | 3/1982 | Eheim | 123/357 |
| 4,325,337 | 4/1982 | Eheim et al. | 123/357 |
| 4,345,563 | 8/1982 | Eheim | 123/357 X |

*Primary Examiner*—Tony M. Argenbright
*Attorney, Agent, or Firm*—Edwin E. Greigg

[57] ABSTRACT

A rotary magnet control element for a distributor injection pump is proposed, which is universally movable by an adjustment means while an engine in running for adjustment of the position of the rotary magnet relative to an annular slide which is reciprocably disposed on a pump piston.

17 Claims, 8 Drawing Figures

FIG.3
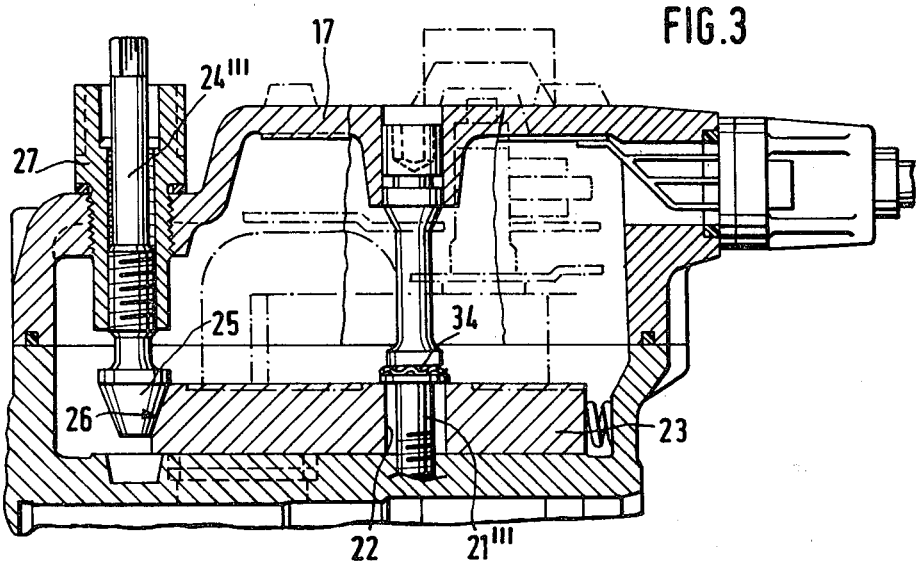
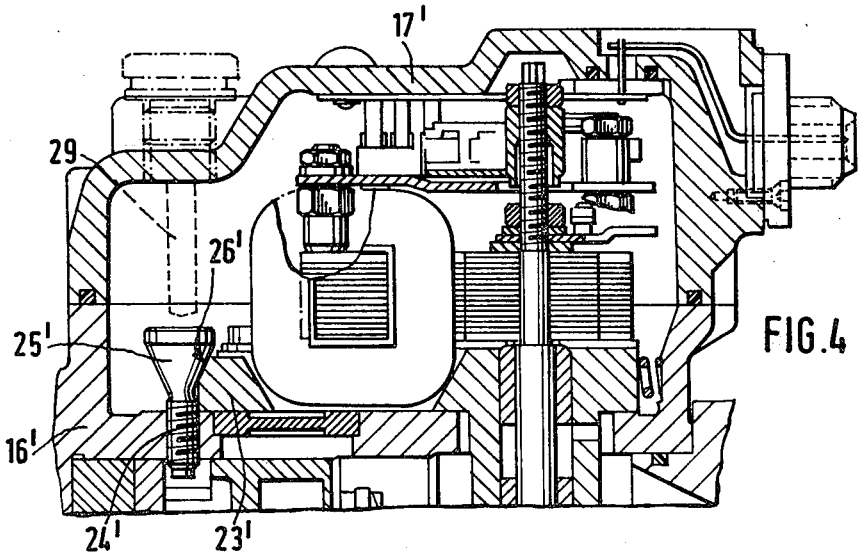
FIG.4

REGULATING DEVICE FOR A FUEL INJECTION PUMP

BACKGROUND OF THE INVENTION

The invention is based on a regulating device. In a known regulating device of this type the shaft must be loosened in the armature in order to adjust the center of rotation of the control element relative to the position of the annular slide and, after making the adjustment, must be re-fastened. This is not possible during operation, since the control element becomes inoperable once the shaft is loosened. However, it is desirable to have an accurate adjustment which can only be made during operation.

OBJECT AND SUMMARY OF THE INVENTION

The regulating device according to the present invention has the advantage that an adjustment can be made during operation, which therefore is very accurate, and that this adjustment is possible without changing the basic orientation of armature to magnet, etc. Three different possibilities are contained as embodiments of the invention.

The invention will be better understood and further objects and advantages thereof will become more apparent from the ensuing detailed description of the preferred embodiments taken in conjunction with the drawings.

BRIEF DESCRIPTION OF THE DRAWINGS

FIGS. 1 to 3 show the first exemplary embodiment; FIGS. 4 to 6 the second exemplary embodiment.

DESCRIPTION OF THE PREFERRED EMBODIMENTS

Figure 1:
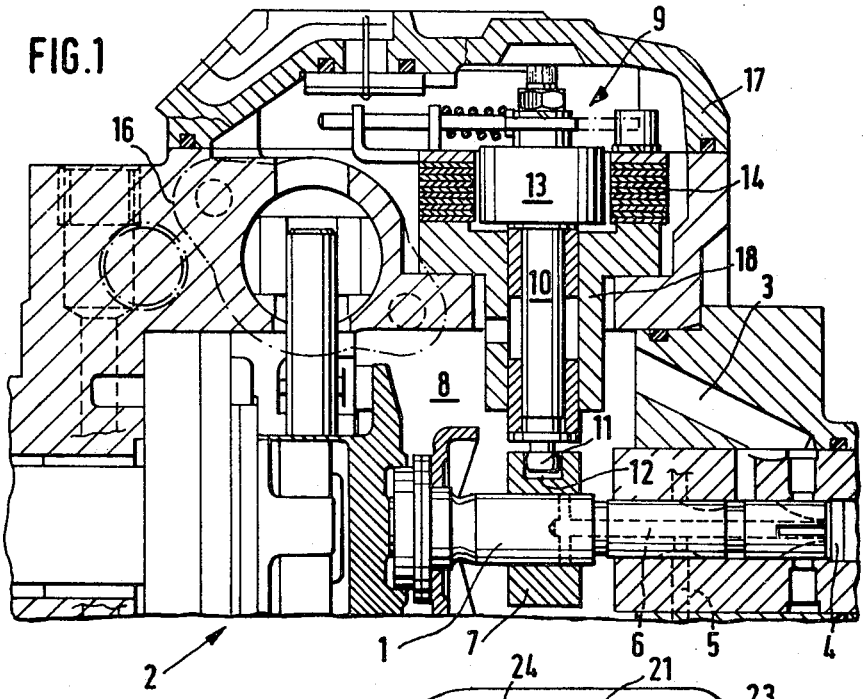

In all examples, a piston 1 is caused to move back and forth as well as to be rotated by a camshaft 2. The fuel, reaching a pump operation chamber 4 by means of an intake channel 3 during the intake stroke, is fed to the combustion engine by means of compression channels 5 during the compression stroke, until a relief channel 5 of the pump operation chamber 4 is opened by means of the annular slide 7, so that the remaining inflowing fuel is brought from the pump operation chamber 4 into a suction chamber 8 of the injection pump during this opening; the intake channel 3 also branches off from this suction chamber 8. The operational amount is therefore determined by the axial position of the annular slide 7. The annular slide 7 is shifted by an electro-magnetic control element 9, by means of an engaging head 11 being disposed eccentrically on a remote end of the magnetic control element shaft 10 which is oriented toward the annular slide 7, with the head 11 being adapted to engage an aperture 12 disposed in the jacket face of the annular slide 7. The shaft 10 is fastened to a rotating armature 13 disposed between the pole pieces 14. The magnet is excited by means of a coil 15. The magnetic control element 9 is fastened to the pump housing 16 and covered by a housing cover 17 of the pump housing.

Figure 2:
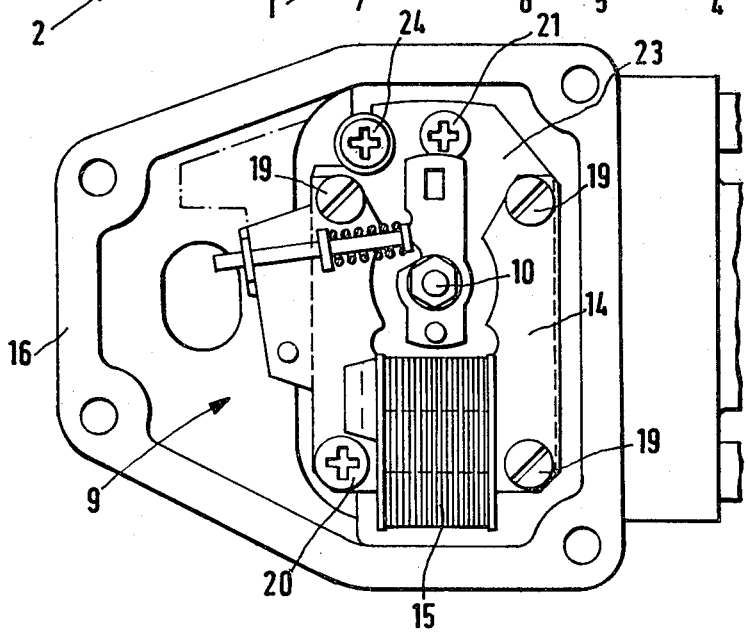

While FIG. 1 shows the described parts mostly in cross section, FIG. 2 shows a plan view of the control element 9 with the housing cover 17 removed. The control element 9 is internally stressed by the screws 19, including a guide and bearing 18 of the shaft 10, and the whole assembly is fastened on the housing 16 by screws 20 and 21. Between screws 20 and 21 is disposed a corrugated washer 34, which is pre-stressed during the adjustment process. In this first exemplary embodiment, essentially shown in FIG. 2, the control element 9 can be rotated on the screw 20, which serves as a shaft, essentially in the amount which—as shown in FIG. 3—the shaft of the assembly screw 21''' allows in the bore 22 in the base plate 23 of the control element 9. The base plate 23 is solidly connected with the guide part of shaft 10. The rotation is accomplished by means of an adjustment screw 24, which moves in a threaded bore of the pump housing 16 and which has a conical portion 25, which acts in concert with a corresponding chamfered face portion 26 of the base plate 23. When turning the adjustment screw 24 forward—seen in conjunction with FIG. 2—the control element 9 is rotated to the right, so that the shaft 10 and with it the engaging head 11 are also displaced towards the right, in the direction of larger amounts of injected fuel, in accordance with FIG. 1. After adjusting the control element 9, it is fastened by tightening of the screws 20 and 21.

The variation shown in FIG. 3 has the adjustment screw 24''' in the form of a threaded spindle, which moves in a sleeve 27 which is screwed into a tap hole of the housing cover 17. This makes it possible to make the adjustment during operation and with the cover closed. After the adjustment is accomplished, the sleeve 27 and the screw 24''' are removed and the bore is closed with a plug element.

In accordance with the present invention the assembly screws 21''' can be formed elongated, so that the screw head is guided in a bore in the housing cover 17, which makes it possible to use a suitable instrument for actuation thereof from outside of the cover. Between the parts of the screw and the housing cover, suitable sealing rings are provided.

Figure 5:
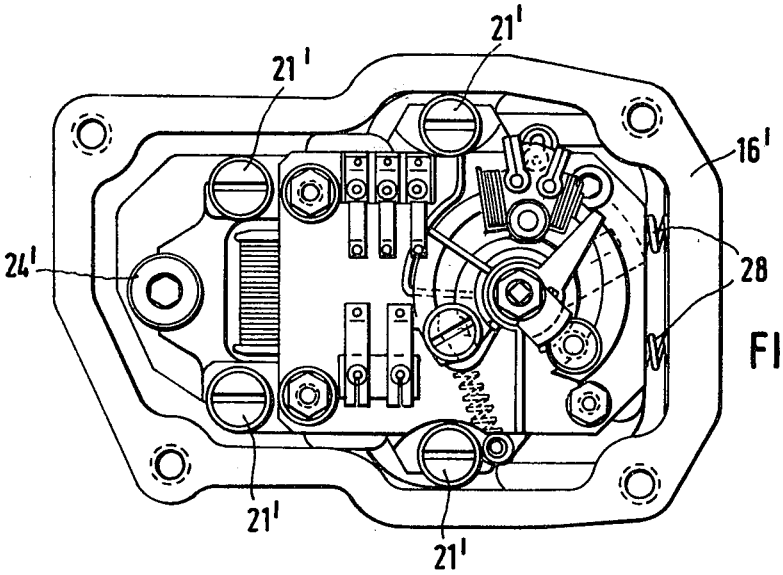
Figure 6:
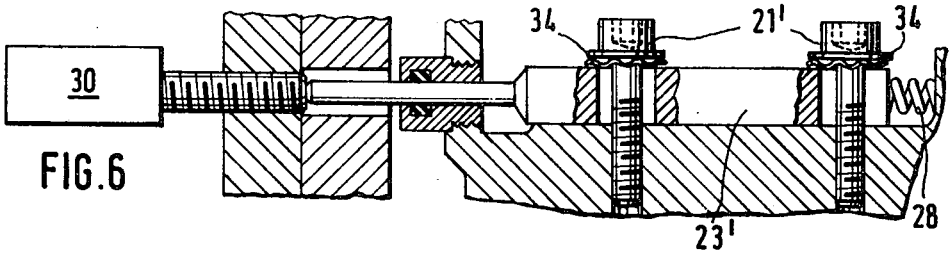

The cross section and view of the second exemplary embodiment shown in FIGS. 4 to 6 correspond with those in FIG. 1. In contrast to the first exemplary embodiment, in this second exemplary embodiment the control element 9 is only moved in a straight line on the housing. The parts corresponding to the first exemplary embodiment have the same reference numbers, but with the prime added. The base plate 23' is fastened to the housing 16' by screws 21'. The adjustment is accomplished by means of an adjustment screw 24', which is guided in the housing 16' and the conical section 25' of which acts with the respective conical face 26' of the base plate 23'. To make the adjustment, the tightening screws 21', moving in slotted holes, are loosened and the base plate 23' is displaced against two springs 28 by the adjusting screw 24'. After adjustment the two screws 21' are fastened as in the first exemplary embodiment. To make turning of the adjustment screw 24' from outside of the housing possible, an adjustment tool 29 (shown by broken lines) which acts on the hexagonal inner part of the head of screw 24' is disposed inside of the housing cover 17'.

In the variation of this second exemplary embodiment shown in FIG. 6 the movement of the base plate 23' is accomplished by a servomotor 30, as a variation of an automatic adjustment.

Figure 7:
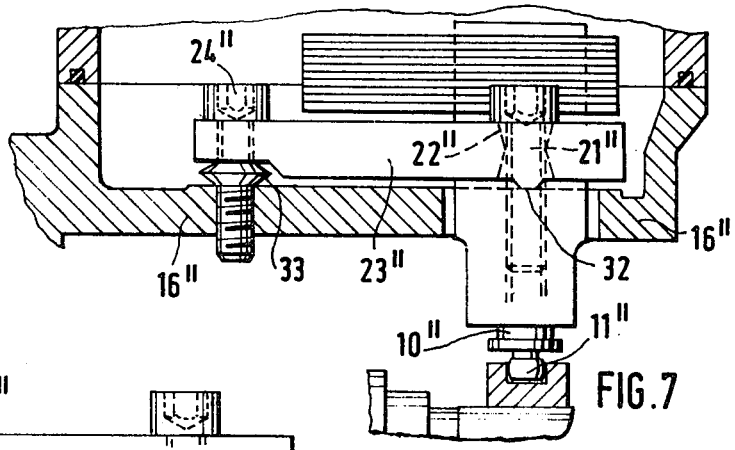
FIGS. 7 and 8 the third exemplary embodiment, in two variations, respectively.
Figure 8:
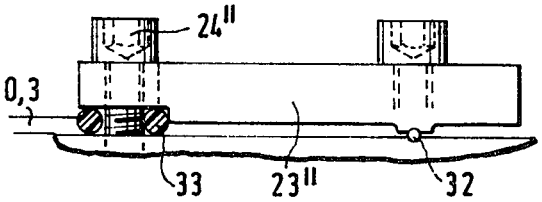

The control element is tilted for the adjustment in the two variations of the third exemplary embodiment shown in FIGS. 7 and 8. The parts equivalent to those in the foregoing examples have the same reference numbers, but with a double prime added. The base plate 23'' can be tilted around a shaft 32, shown only in projection, and the base plate 23'' is disposed in the area of this shaft on the housing 16''. For this, a simple bulge on the base plate 23'' in the main direction of the shaft 32 is sufficient. The base plate 23'' is secured against movement or turning in its position by means of fastening screws 21'', of which only one has been shown by dotted lines as being invisible, and where the bores 22'' containing the screw permit a certain tilting movement of the plate. The adjustment screw 24'' moves, as in the other exemplary embodiments, inside the housing 16'' and more or less tightens an elastic ring 33 disposed between the housing 16'' and the base plate 23''. The more the ring 33 is compressed, the more the engaging head 11'' of the shaft 10'' is moved to the right.

In the exemplary embodiment shown in FIG. 7, the elastic ring is composed of a spring in the form of two plate springs or a corrugated washer; and in the variation of the third exemplary embodiment shown in FIG. 8, the ring 33 consists of an elastic plastic ring. Because of the transformation ratio, i.e., the distance of screw 24'' from shaft 32 or the distance of the engaging head 11'' from the shaft 32 the displacement of the head 11'' is only two-thirds of the tilt path of the base plate 23'' at screw 24''.

To have a self-securing and elastic connection, a corrugated washer 34 can be disposed in all exemplary embodiments between the head of the tension collar of the assembly screw 21 and the base plate 23.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. A regulating device for the supply amount of a fuel injection pump for internal combustion engines including a housing, a fuel injection pump suction chamber in said housing, a pump piston, a pump operation chamber, a relief channel in said pump piston which extends to said pump operation chamber, an annular slide operative on said piston for opening and closing said relief channel in said piston, a quantity control element fastening to said pump housing and including a rotary magnet having an axis and further including means connecting said axis to said annular slide to move said annular slide axially on said pump piston to regulate fuel supply onset or end thereof by opening or closing said relief channel of said pump operation chamber, and an adjustment means positioned relative to said quantity control element for moving said quantity control element for adjustment of its position relative to said annular slide while said engine is running.

2. A regulating device as defined by claim 1, in which said adjustment means includes at least one spring for applying a counter force on said quantity control element, a set screw operable to move said quantity control element against the force of said at least one spring, and a slotted means engaged by at least one assembly screw arranged to be movable along said slotted means for guiding said quantity control element upon adjustment.

3. A regulating device as defined in claim 1, characterized in that said quantity control element is pivotable around an axis disposed parallel to said adjustment means, said axis of said magnet including a set screw operable to move said quantity control element and at least one assembly screw engaging a slotted means arranged to be movable upon an adjusting turning movement imparted to said quantity control element.

4. A regulating device as defined in claim 3, characterized in that said quantity control element is adjusted by means of a set screw having a shaft.

5. A regulating device as defined in claim 4, which includes a base plate associated with said quantity control element, said base plate including a chamfered face portion, said set screw moves parallel to the axis of said quantity control element in said housing and further that said set screw has a conical shaft portion arranged to cooperate with said chamfered face portion of said base plate associated with said quantity control element.

6. A regulating device as defined in claim 4, characterized in that said base plate has an end wall and said set screw engages said end wall.

7. A regulating device as defined in claim 1, characterized in that said quantity control element further includes a base plate, said base plate including a tilt bearing means in proximity to said magnet axis and said adjustment means including an adjusting screw means spaced from said tilt bearing means serving to tilt said quantity control element and to adjust said annular slide on said pump piston.

8. A regulating device as defined in claim 7, characterized in that said set screw is arranged self-lockingly in said housing.

9. A regulating device as defined in claim 1, which includes fastening screws for locking said quantity control element in a locked position against further movement after adjustment.

10. A regulating device as defined in claim 1, characterized in that said adjustment means can be regulated from outside of said housing while said housing is closed.

11. A regulating device as defined in claim 10, characterized in that said adjustment means comprises a threaded spindle arranged to move in a sleeve threaded into a cover on said housing.

12. A regulating device as defined in claim 11, characterized in that said sleeve further comprises a removable assembly replaceable by means of a plug.

13. A regulating device as defined in claim 9, characterized in that said fastening screws are operable exteriorly of said housing through a cover means.

14. A regulating device as defined in claim 13, characterized in that said fastening screw includes a headed portion which is cylindrical and guided in a bore.

15. A regulating device as defined in claim 14, including a sealing ring which serves as a seal between said bore and said headed portion.

16. A regulating device as defined in claim 13, characterized in that said fastening screw further includes a collar to cooperate with said base plate and that a corrugated washer is disposed between said collar and said base plate.

17. A regulating device as defined in claim 6, which includes a servomotor by which adjustment of said base plate is accomplished by means of said servomotor acting on said set screw.

* * * * *